US010251476B2

(12) United States Patent
Glöckl

(10) Patent No.: US 10,251,476 B2
(45) Date of Patent: Apr. 9, 2019

(54) WORK SURFACE ARRANGEMENT

(71) Applicant: aeris GmbH, Haar bei München (DE)

(72) Inventor: Josef Glöckl, Kirchheim (DE)

(73) Assignee: aeris GmbH, Haar bei München (DE)

( * ) Notice: Subject to any disclaimer, the term of this patent is extended or adjusted under 35 U.S.C. 154(b) by 0 days.

(21) Appl. No.: 15/507,261

(22) PCT Filed: Jun. 10, 2015

(86) PCT No.: PCT/EP2015/062975
§ 371 (c)(1),
(2) Date: Feb. 28, 2017

(87) PCT Pub. No.: WO2016/062415
PCT Pub. Date: Apr. 28, 2016

(65) Prior Publication Data

US 2017/0303680 A1 Oct. 26, 2017

(30) Foreign Application Priority Data

Oct. 20, 2014 (DE) ..... 10 2014 015 407

(51) Int. Cl.
*A47B 21/03* (2006.01)
*A47B 21/04* (2006.01)
*A47B 21/06* (2006.01)

(52) U.S. Cl.
CPC ..... *A47B 21/03* (2013.01); *A47B 21/04* (2013.01); *A47B 2021/066* (2013.01)

(58) Field of Classification Search
CPC .... A47B 2021/066; A47B 21/04; A47B 21/00
USPC ..... 108/50.01, 50.02; 312/107; 52/36.4, 52/36.5, 239
See application file for complete search history.

(56) References Cited

U.S. PATENT DOCUMENTS 5,057,039 A * 10/1991 Persing ..... A47B 21/06 248/231.71
5,282,341 A * 2/1994 Baloga ..... A47B 83/001 49/41
5,516,298 A * 5/1996 Smith ..... A47B 21/06 439/131

(Continued)

FOREIGN PATENT DOCUMENTS

DE 102012100847 A1 7/2013
EP 0335228 A1 10/1989

OTHER PUBLICATIONS

International Search Report (in German with English Translation) for PCT/EP2015/062975, dated Aug. 20, 2015; ISA/EP.

*Primary Examiner* — Jose V Chen
(74) *Attorney, Agent, or Firm* — Harness, Dickey & Pierce, P.L.C.

(57) ABSTRACT

The invention relates to a work surface arrangement consisting at least of a standing work surface, a seated work surface, at least one planning board and a movement space having a center as basic elements; said basic elements are arranged at a random angle relative to each other around the movement space and are each arranged at a distance $a_1, \ldots, a_n$ around an imaginary center, said distance lying within a radius ranging from about 0.30 m to 2.00 m, measured from a front edge of the basic element to the imaginary center.

18 Claims, 3 Drawing Sheets

(56) References Cited

U.S. PATENT DOCUMENTS

Figure 1:
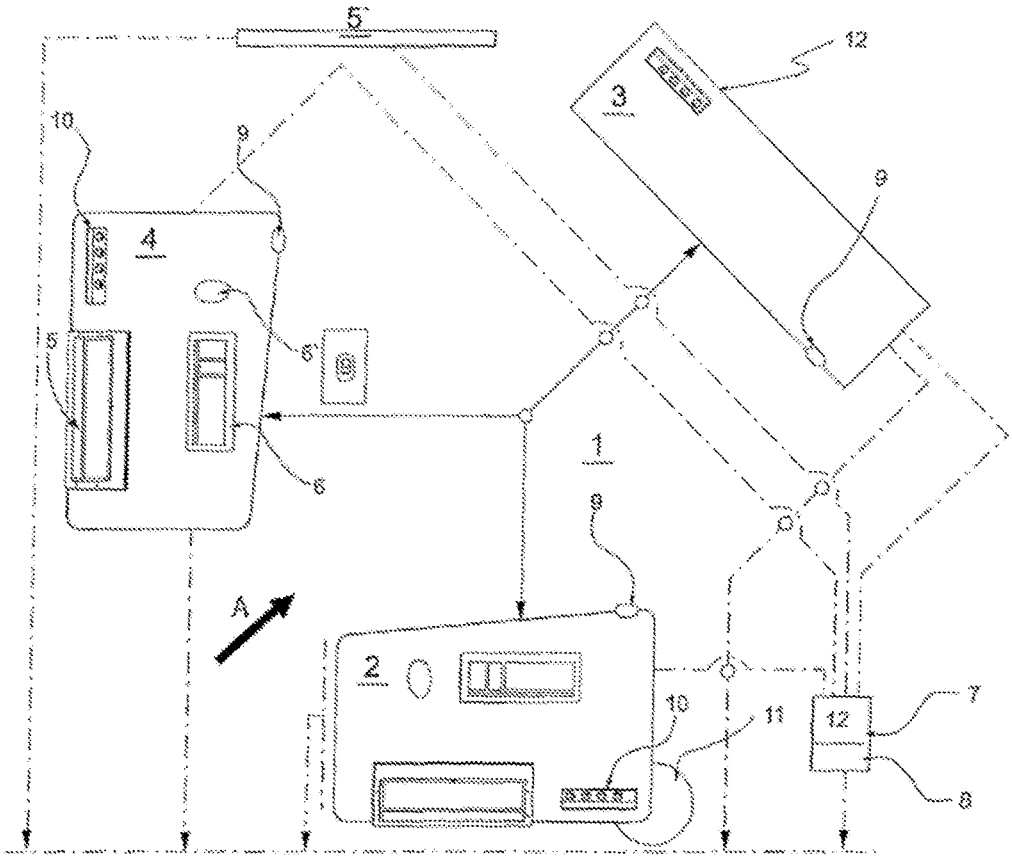

| | | | | |
|---|---|---|---|---|
| 5,970,662 | A * | 10/1999 | Corcorran | A47B 21/00 52/239 |
| 5,979,118 | A * | 11/1999 | Gortsema | A47B 21/00 52/239 |
| 6,474,025 | B1 * | 11/2002 | Faiks | A47B 21/00 52/239 |
| 6,644,748 | B2 * | 11/2003 | Tholkes | A47B 9/00 248/280.11 |
| 9,883,740 | B2 * | 2/2018 | Epstein | A47B 21/06 |
| 2007/0170826 | A1 * | 7/2007 | Tsao | A47B 21/00 312/223.3 |
| 2008/0061662 | A1 | 3/2008 | Lin | |
| 2009/0293773 | A1 * | 12/2009 | Miller | A47B 21/00 108/28 |
| 2011/0075337 | A1 * | 3/2011 | Riley | A47B 21/0073 361/679.2 |
| 2014/0053759 | A1 | 2/2014 | Matthai et al. | |
| 2015/0230602 | A1 | 8/2015 | Glockl | |
| 2016/0170402 | A1 * | 6/2016 | Lindstrom | A47B 9/00 700/275 |
| 2017/0135587 | A1 * | 5/2017 | Desroches | A47B 9/20 |

* cited by examiner

WORK SURFACE ARRANGEMENT

CROSS REFERENCE TO RELATED APPLICATIONS

This application is a U.S. National Phase Application under 35 U.S.C. 371 of International Application No. PCT/EP2015/062975 filed on Jun. 10, 2015 and published in German as WO 2016/062415 A1 on Apr. 28, 2016. This application claims priority to German Application No. 10 2014 015 407.6 filed on Oct. 20, 2014. The entire disclosures of all of the above applications are incorporated herein by reference.

FIELD

The disclosure relates to a work surface arrangement consisting of at least the following basic elements: a standing work surface, a seated work surface, at least one Orga-board organization center and a movement space.

BACKGROUND

Workspace assemblies of the aforementioned type are well known in the prior art. Due to the demands of a modern society for greater numbers of office jobs and work at computers, sitting and working at a desk in its present form has become the predominant body posture of the working population. The increasing amount of time spent by individuals working at desks calls for enhanced ergonomic measures to prevent tension, pain and long-term damage to the musculoskeletal system resulting from office work or sitting at a desk. Prolonged periods of sitting can be hazardous to your health, as is demonstrated by the increasing incidence of muscle and musculoskeletal disorders. Physical abilities such as conditioning, muscle strength, reactivity and responsiveness may be lost, and limited functioning of the immune system and the internal organs may also result in people who spend all their time in a seated position.

To keep the body healthy, it may be necessary to keep the body moving more than is possible with currently conventional seating. Ergonomic work can result in increased efficiency of desk work, and a variety of measures for improving flexibility and ergonomics in the work environment have already been proposed, such as ergonomic chairs for improving the seated posture of users. Also known are standing desks, which can be used with a suitable desktop for working in a standing position, for example with books or other documents.

These measures have contributed to increasing efficiency in work environments, but they are not able to keep up with modern demands given the growing need for multitasking and increasing amounts of office work. The latter is generally organized in such a way that it can be accomplished with minimal movement effort, however this has proven to be detrimental when extended over the entire workday since the lack of movement leads to a lack of concentration. Complex movements are considered to be extremely positive for the human organism, whereas linear movements are considered more harmful to the organism.

It is known to arrange work stations in the form of a "cockpit solution", in which any superfluous movement is avoided and the time spent per operation is optimized in the interest of saving time, however this type of work can actually decrease work efficiency and wellness. In contrast, a workspace configuration in which phases of exertion and relaxation can be alternated and working positions and postures can be varied in short intervals can increase the working efficiency of those concerned.

DE 10 2012 100 847 discloses an arrangement of desks in a substantially circular configuration, in which a first desktop and a second desktop are provided, along with an organization center that includes a third desktop, and in which the first, second and third desktops are each embodied as separate from the others and at different heights.

Although such an arrangement can induce substantially different working postures by users changing from one desktop to another, thereby responding to the need for greater movement, it has been found that users who are performing intensive tasks will tend to remain in the same space, and as a result, users do not take advantage of the available opportunity to assume different postures and perform different series of movements to the extent desired.

SUMMARY

It is therefore the object of the disclosure to provide means and methods by which the efficiency and flexibility of users in work environments, along with the ergonomics and flexibility of the work environment itself, can be improved.

Since working at an office workstation prompts a need for movement. This need is accompanied by the need to complete the office work.

By using the work surface arrangement according to the disclosure, the completion of work tasks is linked with the need to move. According to the disclosure, these movements must be executed for individual tasks, as otherwise a subsequent work process cannot be carried out.

Electronic elements are advantageously provided, specifically at least one time measuring unit, a control unit in which an ergonomics detection program is stored, an information unit, and at least one sensor for detecting the presence of a person within a defined area of the basic elements, wherein at least one of said basic elements is electronically coupled to the control unit, and the control unit communicates at least one signal, acoustically or via the display, to a user, based on a movement profile. The user is notified by means of these components that it is time to change workstations, while at the same time or with a time lag, the respective display is switched off and the display at the next workstation is switched on showing the same image.

Particularly useful is an e-box, consisting of a power strip having a power output part/section (power outlets) and a signal output/input part (USB), which is arranged in at least one of the basic elements, in a plug-in socket which has both a power connection (220V AC and 5V DC) and a signal connection (all standard USB plugs and sockets).

In this case it is provided that all basic elements and all electronic devices, along with the e-box, are signal connected to one another via conventional transmission connections.

The features of the disclosure make it possible to encourage the user at predefined time intervals to change workstations and in so doing to assume a different posture and also to move, i.e. stand up and walk a few steps. This encouragement is particularly effective if the current workstation is rendered inoperative by deactivating the display, for example, forcing the user to move to the other workstation in order to continue working. However, textual or pictorial prompts on the display to change workstations may be sufficient to cause the worker to switch stations.

Other advantageous variants of the disclosure are characterized in the dependent claims and will be described in greater detail in the following, together with the description of the preferred embodiment of the disclosure, with reference to the figures.

DRAWINGS

Figure 2:
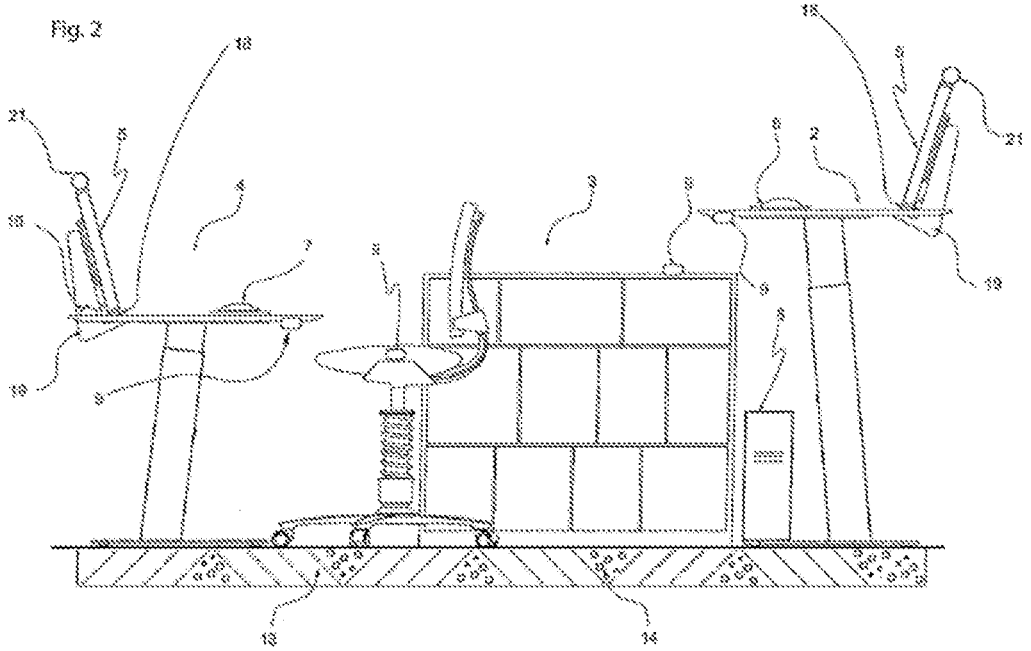
Figure 5:
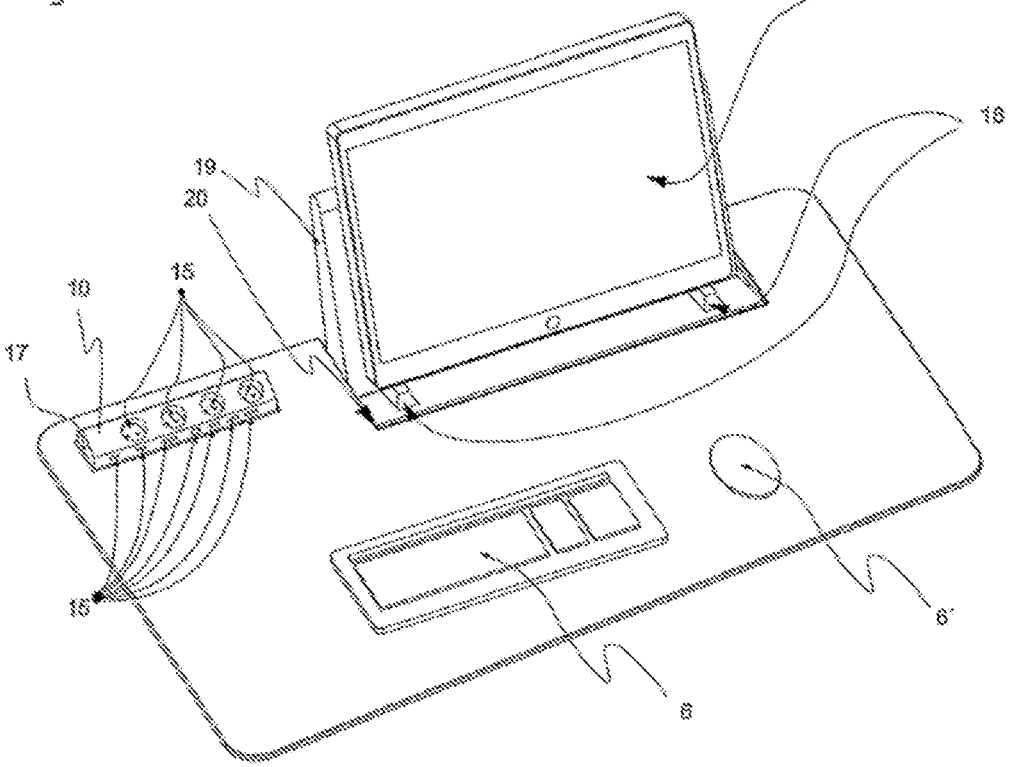
Figure 3:
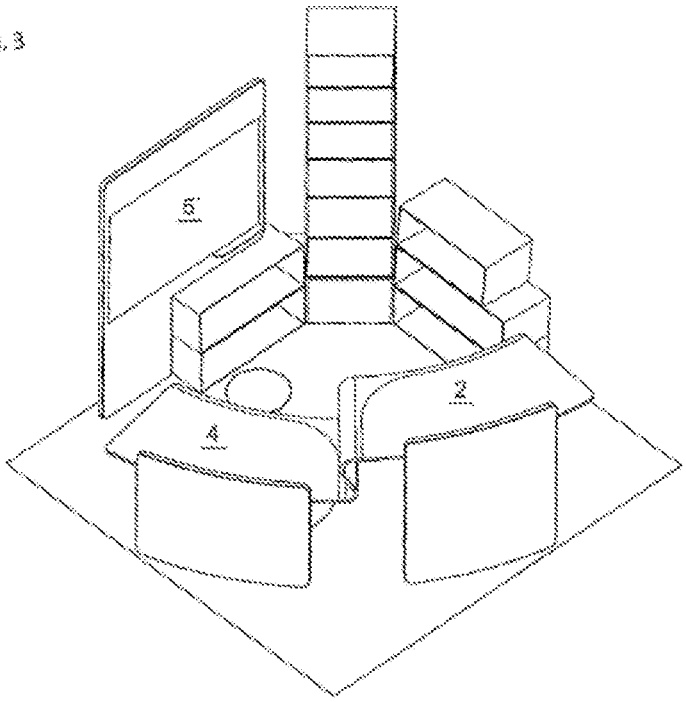
Figure 4:
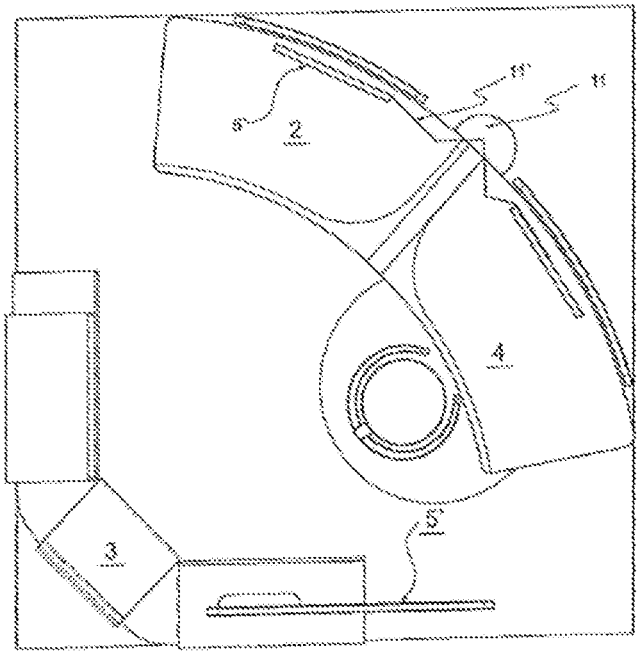

FIG. 1 a schematic diagram of a plan view of a workspace unit,

FIG. 2 a view of the workspace unit of FIG. 1 from the side,

FIG. 3 a view of a workspace unit with a tall Orgaboard organization center, FIG. 4 a plan view of a workspace unit, FIG. 5 a perspective view of an e-box

DESCRIPTION

FIG. 1 shows a schematic diagram of a plan view of a workspace unit according to the disclosure, consisting of various basic elements. In the embodiment example shown, the basic elements are a standing work surface 2, a seated work surface 4 and an Orgaboard 3 organization center in the form of a sideboard. The basic elements shown are rollable and therefore movable. Mobility may also be provided by sliding nubs rather than rollers. The individual basic elements are arranged at any desired angle relative to one another, substantially at the edge of a movement space 1 and around this space, each at a distance $a_1, \ldots a_n$ within a radius ranging from about 0.30 m to 2.00 m, measured from a front edge of the basic element to an imaginary center.

The Orgaboard organization center shown in FIG. 2 is merely one embodiment example; in another embodiment, the Orgaboard organization center may be configured as tall, so that the person must stretch to reach the upper shelves.

Information units 9 in the form of sensors/motion detectors with photoelectric sensors or pressure sensors in seating surfaces are assigned to the basic elements. However, one common unit may also be provided for all the basic elements.

A visual display unit 5 and a keyboard as input unit 6 are provided at 4. Standing work surface 2 is generally likewise provided with a visual display unit and an input unit 6. It is understood that a computer mouse also forms part of an input unit. Visual display unit 5 stands on work surfaces 2 and 4 or may, depending on the embodiment of the arrangement, be pivotably supported on an equipment support column 11, cf. FIG. 4. A telephone may also be held on column 11. Keyboard 6 is provided on all work surfaces, whereas users may optionally take the mouse along with them when they move. The keyboard, shown resting on the work surface in FIG. 1, can optionally be pushed underneath work surfaces 2 and 4, leaving the entire surface free to hold drawings, for example.

A time measuring unit 7 is coupled to at least one of the basic elements in such a way that it can detect how much time a person spends at the basic element being monitored, e.g. at the standing work surface.

The electronic devices are interconnected in terms of signals. At the same time, this connection is a connection to a control unit 8 and or to CPU 12, in which a control program is also stored. In the control program, a target profile is established, which is compared with an actual profile in order, depending on the content of the respective profiles, sends a prompt stating that the current workstation will remain available for a predetermined amount of time or is no longer available, and therefore the workstation must be changed. The target profile may be fully or partially personalized and may also be fed with desired data by the person at the workstation. This allows a variety of requirements to be met, making it possible to make adjustments where appropriate, in keeping with the current task. Alternatively, however, only a supervisor may be permitted to make changes to the settings.

Integrated into the CPU is a time measuring unit 7, which determines, together with the information units 9, how long, for example, the visual display unit has been in operation/switched on and how long work has been performed on the input unit. These data are fed to control unit 8 and processed. As a result of this processing, which includes a comparison of the actual profile with the target profile, a signal sounds, or notice is provided on the visual display unit indicating the expiration of the session time at that station, or the workstation is completely disconnected from the power supply, so that the person is forced to continue working at the other workstation in the workspace unit.

The basic elements are arranged spaced by a predetermined distance around a central point, with the respective distances $a_1, \ldots a_n$ from an inner edge of a basic element to the center point varying, but ranging from 0.3 m to 2 m. A shorter distance will limit the range of movement too much, and if the space is larger, movement will quickly become a burden.

FIG. 2 shows a view of the workspace unit of FIG. 1 from the side. The information units 9 are mounted below work surfaces 2 and 3 and on the Orgaboard organization center. Signals are transmitted via W-LAN or Bluetooth to control unit 8. The information units 9 in this case are commercially available ultrasound sensors. Information unit 9 located on the chair is a pressure sensor.

The cross-sectional view of the floor shows floor panels 13, which are made of a soft material (Tempur) with hard-wearing resilience in which hard inclusions are embedded 14, which can be perceived by the feet during standing and walking.

FIG. 3 shows a view of a workspace unit with work surfaces 2 and 4 arranged in a semicircle, along with a tall Orgaboard 3 organization center and a whiteboard, which may be a conventional or a digital whiteboard. In the latter case, the instruction to move also appears on the whiteboard. The work surface combination shown in FIGS. 3 and 4 joins the standing work surface to the seated work surface by means of an integral plate provided with two levels. This results in an optimum utilization of space. Particularly advantageous in this embodiment, as shown in FIG. 4, is the option of arranging a single column, which can serve as an equipment support, at the outer edge between the two work surfaces. For instance, a visual display unit 5, for example, may be held on a swivel arm 11'. The column may also support a communication indicator 16. The communication indicator 16 supplies a visual signal, either when it is switched on by the person via a key function because he/she does not wish to be disturbed, or when the person is using the telephone. In that case the communication indicator 16 is switched on via the telephone system or the computer.

FIG. 5 shows a perspective view of an e-box 10. The e-box comprises a plurality of power outlets in the form of sockets 15, along with signal or data inputs/outputs 15'. The data inputs/outputs 15' may also be equipped with a cable drum with a winding device in order to prevent a tangling of cables.

The e-box is placed in a plug-in socket 17, which is connected to the mains supply and the internal data network of the workstation arrangement. Such a plug-in socket may be provided at each basic element, with a snap connection preventing the e-box from separating from the plug-in socket when a plug is pulled out.

The disclosure is not limited to the above-described preferred embodiment. Rather, a number of variants are conceivable which make use of the described solution in fundamentally different configurations.

For instance, it may also be appropriate for the basic elements to be arranged side by side in a row, so that the worker is forced to walk long distances.

In general, a work surface arrangement consisting at least of the basic elements: standing work surface, seated work surface, at least one Orgaboard organization center, and a movement space having a central point is proposed, in which the individual basic elements are arranged around the movement space at any desired angle relative to one another and each at a distance $a_1, \ldots a_n$, within a radius ranging from about 0.30 m to 2.00 m, measured up to a front edge of the respective basic element. As additional features, a visual display unit, a computer mouse, and a keyboard are provided on each of the two work surfaces, wherein the at least one Orgaboard organization center in a vertical arrangement has an area for office supplies and a filing cabinet for documents or other objects.

Also provided is an e-box consisting of a power strip which has a power output part/section (power outlets) and a signal output part (USB), wherein at least one of the basic elements has a plug-in socket which is provided with a power connection and a signal connection, into which the e-box can be inserted/plugged.

The work surface arrangement is further characterized by at least one time measuring unit [clock] (7), a control unit [switching computer] (8) in which an ergonomics detection program (control program) is stored, and an information unit [motion sensor] (9) having at least one sensor for detecting the presence of a person at the respective basic elements and in the movement space, wherein said electronic devices are connected to a common CPU (8), and at least one of said basic elements is electronically coupled to the control unit, and the control unit communicates at least one signal, acoustically or via the display, to a user, based on a movement profile.

The CPU is arranged between the workstations.

The basic elements or the CPU have an input for a telephone headset. It is provided that all basic elements and all electronic devices, along with the e-box, are signal connected to one another. The control unit uses signals to deactivate the visual display unit (5) currently in use, while at the same time activating the other visual display unit or switching the display.

It is provided that the signal connection is a wireless transmission, e.g. "Bluetooth" or WI-FI connection or can be controlled via software with a USB port. The ergonomics detection program compares the actual movement profile with a target movement profile and activates a signal when predefined target values are reached or departed from.

The time measuring unit (7) and control unit (8) electronic devices are combined in a computer (12), wherein the sensor is a motion sensor that cooperates with at least one photoelectric sensor, or is a Doppler sensor.

At least some areas of the movement space are designed as having a resilient floor (actively dynamic floor), which is provided with solid inclusions that can be perceived with the feet. An actively dynamic tilt stool and/or a standing aid may be arranged in the movement space.

A communication indicator is arranged on at least one of the basic elements and is connected to the control unit and/or the CPU. In the case of activity, it sends out at least visual signals (LED). The communication indicator is connected to the telephone and the keyboard and is activated by the two basic elements. LED strips may also be arranged at the door to the office, and can light up when the telephone is in use. The communication indicator may also be activated via the computer if the user does not wish to be disturbed.

The disclosure further relates to a method for organizing the working time spent at a workstation which has at least two work surfaces of different heights, wherein at least two different individual IT workstations are furnished at the workstation, specifically a standing work surface (2) and a seated work surface 4, each equipped with a visual display unit 5 and a keyboard 6, and optionally a sideboard embodied as an Orgaboard 3 organization center, which can be equipped with an e-box, and which are connected to one another via a signal device, wherein, according to a predefined time-dependent movement profile, a signal is generated by a signal generator, informing the worker that he should continue his activity at another movement space before basic element within the. The signal appears on the visual display unit currently in use, and provides information as to the amount of time spent working at the current visual display unit and prompts the user to switch workstations.

LIST OF REFERENCE SIGNS workspace unit 1,
standing work surface 2,
Orgaboard organization center 3
seated work surface 4
visual display unit 5, 5'
input unit 6, 6' (mouse)
time measuring unit 7
control unit 8
information units 9
e-box 10
column 11
CPU 12
floor panel 13
inclusions 14
plug-in socket 15
communication element 16

The invention claimed is:

1. A work surface arrangement, comprising a plurality of basic elements including a standing work surface, a seated work surface, at least one organization center, and a movement space having a central point, wherein the plurality of basic elements are arranged at any desired angle relative to one another around the movement space, each of the plurality of basic elements being located at a distance of $a_1, \ldots a_n$ in a radius range of approx. 0.30 m to 2.00 m, measured from a front edge of the respective one of the plurality of basic element to an imaginary center point, and a control device is programmed to determine a duration at a first of the plurality of basic elements, the control device is programmed to compare the determined duration at the first basic element with a target profile for the first basic element, and the control device is programmed to send a signal to a user to move to a different basic element of the plurality of basic elements after the duration has expired at the first of the plurality of basic element.

2. The work surface arrangement according to claim 1, wherein on each of the standing and seated work surfaces include, a visual display unit, a computer mouse and a keyboard, and the at least one organization center in a vertical arrangement has an area for office supplies, and a filing cabinet for documents or other objects.

3. The work surface arrangement according to claim 2, wherein an ergonomics detection program compares an actual movement profile with a target movement profile, and activates a signal when predefined target values are achieved or deviated from.

4. The work surface arrangement according to claim 1, wherein an e-box, including a power strip which has a power output part/section (power outlets) and a signal output/input part (USB), wherein in at least one of the plurality of basic elements includes a plug-in socket, which has at least one of a power connection and a signal connection, which can be inserted/plugged into the e-box.

5. The work surface arrangement according to claim 4, wherein the signal connection is a wireless transmission, or can be controlled via software with a USB port.

6. The work surface arrangement according to claim 1, wherein at least one time measuring unit, a control unit in which an ergonomics detection program (control program) is stored, and an information unit having at least one sensor for detecting a presence of a person at a respective one of the plurality of basic elements and in the movement space, wherein said at least one time measuring unit, said control unit and said information unit are connected to a common CPU, and at least one of the plurality of said basic elements is coupled electronically to the control unit, and the control unit communicates at least one signal, acoustically or via a visual display unit, to a user, dependent on a movement profile.

7. The work surface arrangement according to claim 6, wherein the CPU is arranged between at least two of the plurality of basic elements.

8. A work surface arrangement according to claim 6, wherein an input for a telephone headset is arranged on at least one organization center or a common CPU.

9. The work surface arrangement according to claim 6, wherein a plurality of the basic elements, at least one time measuring unit, the control unit, the information unit and the e-box are signal connected to one another.

10. The work surface arrangement according to claim 6, wherein the control unit deactivates a first display unit currently in use by means of a signal, while at the same time a second display unit can be activated or the display switched.

11. The work surface arrangement according to claim 6, wherein the time measuring unit and control unit are combined in a computer, and a motion detector cooperates with at least one photoelectric sensor.

12. The work surface arrangement according to claim 1, wherein at least one area of the movement space is designed as including a resilient floor, which is provided with solid inclusions that can be perceived with the feet.

13. The work surface arrangement according to claim 1, wherein an active dynamic tilt stool and/or a standing aid are arranged in the movement space.

14. The work surface arrangement according to claim 1, wherein a communication indicator is arranged on at least one of the plurality of basic elements and is connected to a control unit and/or a CPU, and sends out at least visual signals during activity.

15. The work surface arrangement according to claim 14, wherein the communication indicator is connected to a telephone and a keyboard, and can be activated by both.

16. The work surface arrangement according to claim 14, wherein LED strips at a door light up when a telephone is in use, but may also be activated via a computer if a user does not wish to be disturbed.

17. A method for organizing a working time spent at a workstation which has at least two work surfaces of different heights, wherein at least two different individual IT workstations are furnished at the workstation, specifically a standing work surface and a seated work surface, each of which is equipped with a visual display unit and a keyboard, and optionally a sideboard embodied as an organization center, which is equipped with a control device that is programmed to determine a duration at a first of the two IT workstations, the control device is programmed to compare the determined duration at the first of the two different IT workstations with a predetermined time-dependent movement profile and which are connected to one another via a signal device, wherein, according to the predefined time-dependent movement profile, a signal is generated by a signal generator, informing a worker that he should continue his activity at another IT workstation.

18. The method for organizing the working time spent at a workstation in an according to claim 17, wherein the signal appears on the visual display unit currently in use, and provides information as to the interval of time spent working at the current visual display unit and prompts the user to switch IT workstations.

* * * * *